US012252329B2

(12) United States Patent
Hokanson et al.

(10) Patent No.: US 12,252,329 B2
(45) Date of Patent: Mar. 18, 2025

(54) FLEXIBLE POLYMER PACKAGING WITH INCREASED RIGIDITY

(71) Applicant: Kimberly-Clark Worldwide, Inc., Neenah, WI (US)

(72) Inventors: Brandon M. Hokanson, Appleton, WI (US); Nicholas D. Krueger, Greenville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/553,863

(22) PCT Filed: May 14, 2021

(86) PCT No.: PCT/US2021/032503

§ 371 (c)(1),
(2) Date: Oct. 4, 2023

(87) PCT Pub. No.: WO2022/240417

PCT Pub. Date: Nov. 17, 2022

(65) Prior Publication Data

US 2024/0217722 A1 Jul. 4, 2024

(51) Int. Cl.
*B65D 83/08* (2006.01)
*A47K 10/32* (2006.01)
(Continued)

(52) U.S. Cl.
CPC ..... *B65D 83/0805* (2013.01); *A47K 10/32* (2013.01); *A47K 10/421* (2013.01);
(Continued)

(58) Field of Classification Search
CPC .... B65D 83/08; B65D 75/52; B65D 83/0805; A47K 10/32; A47K 10/421; A47K 2010/3266
(Continued)

(56) References Cited

U.S. PATENT DOCUMENTS 2,965,224 A 12/1960 Harwood
3,885,015 A 5/1975 Ono et al.
(Continued)

FOREIGN PATENT DOCUMENTS

CN 106005770 A * 10/2016 ..... B65D 83/0817
WO WO2006016175 A2 2/2006
WO WO2013109718 A1 7/2013

OTHER PUBLICATIONS

PCT Search Report Corresponding to Application No. PCT/US2021/032503 on Sep. 6, 2021.
(Continued)

*Primary Examiner* — Chun Hoi Cheung
(74) *Attorney, Agent, or Firm* — Dority & Manning, P.A.

(57) ABSTRACT

A flexible container defining an interior volume and having one or more geometric deformations on one or more sidewalls is provided. The flexible container exhibits an increased rigidity due to the one or more geometric deformations such that the flexible container maintains a substantial portion of an internal volume and/or a height of the sidewall(s) of the flexible container when some or all of an article contained in the internal volume is dispensed. A method of forming a flexible container is also provided that includes forming a flexible container from a film or laminate, where one or more geometric deformations are formed on a wall of the flexible container.

20 Claims, 6 Drawing Sheets

(51) Int. Cl.
*A47K 10/42* (2006.01)
*B65D 75/52* (2006.01)

(52) U.S. Cl.
CPC ..... *B65D 75/52* (2013.01); *A47K 2010/3253* (2013.01); *A47K 2010/3266* (2013.01)

(58) Field of Classification Search
USPC ..... 206/494, 449, 233; 229/101; 220/8
See application file for complete search history.

(56) References Cited

U.S. PATENT DOCUMENTS

| | | | | |
|---|---|---|---|---|
| 4,064,206 | A | 12/1977 | Seufert | |
| 6,766,919 | B2 * | 7/2004 | Huang | B65D 83/0805 221/63 |
| 6,776,288 | B2 | 8/2004 | Kopecky | |
| 7,172,093 | B2 * | 2/2007 | Bando | B65D 83/0805 221/63 |
| 7,727,620 | B2 | 6/2010 | Yamada et al. | |
| 7,901,758 | B2 | 3/2011 | Rasmussen | |
| 8,658,263 | B2 | 2/2014 | Kawasumi et al. | |
| 10,875,701 | B2 * | 12/2020 | McGhee, Jr. | A47K 10/42 |
| 10,894,656 | B2 * | 1/2021 | Lange | B65D 75/58 |
| 11,117,702 | B2 * | 9/2021 | Esseny | B65D 5/0005 |
| 2006/0078654 | A1 | 4/2006 | Kushner et al. | |
| 2013/0143014 | A1 | 6/2013 | Kawasumi et al. | |
| 2016/0039138 | A1 | 2/2016 | Rasmussen | |

OTHER PUBLICATIONS

Wang et al., Stretchable Thin Film Materials: Fabrication, Application, and Mechanics, Journal of Electronic Packaging, vol. 138—Issue 2, Apr. 18, 2016, 22 pages, https://doi.org/10.1115/1.4032984.

* cited by examiner

FLEXIBLE POLYMER PACKAGING WITH INCREASED RIGIDITY

RELATED APPLICATIONS

The present application is the national stage entry of International Patent Application No. PCT/US2021/032503 having a filing date of May 14, 2021, which is incorporated herein in their entirety by reference thereto.

BACKGROUND OF THE INVENTION

A wide variety of storing and dispensing containers exist in the market, particularly those for storing and dispensing nonwoven products, including sheet-like products, such as wet or dry wipes, and facial tissues, as well as rolled sheet-like products. For example, soft, flexible packages are commercially available that provide a compact and easily transportable container for storing and dispensing stacks or rolls of nonwoven article(s). Such flexible packages can define an opening for dispensing the nonwoven article(s) contained therein that can include a rigid flip top positioned above the opening that has a hinged lid for opening and closing the package, or side walls having flexible edges which may be pressed and sealed, providing resealable packaging. Alternatively, some flexible packages may have no resealable opening.

Sheet type nonwoven articles such as wipes and facial tissues have been made from a variety of materials which can be dry or wet when used. Wet wipes can be moistened with a variety of suitable wiping solutions. Typically, both wet and dry articles have been stacked in a container in either a folded or unfolded configuration. For example, containers of wet wipes and facial tissues have been available wherein each of the wet wipes stacked in the container has been arranged in a folded configuration such as a c-folded, z-folded, or quarter-folded configuration as are well known to those skilled in the art. Sometimes each folded article is interfolded with the article immediately above and below it in the stack of articles. In an alternative configuration, the articles have been placed in a container in the form of a continuous web of material that includes perforations adapted to allow for separation of individual articles from the web upon the application of a pulling force, such as in one example, which may be known in the art as "center dispensing". Articles, such as wet wipes have been used for baby wipes, hand wipes, personal care wipes, household cleaning wipes, industrial wipes, and the like.

Some of the conventional packages have also been configured to provide "one-at-a-time" dispensing of each article which can be accomplished using a single hand after the package has been opened. "Pop-up" configurations of dispensers can advantageously help provide the aforementioned single-handed, "one-at-a-time" dispensing. In "pop-up" configurations, when an article is removed from the dispenser, the article pulls along the leading end of the succeeding article in the package, by virtue of the succeeding article being in operative contact with the leading article such as via interfolding, via adhesive bonding, or via an integral connection along a line of weakness. Preferably, as the leading article is pulled out of and away from the package, the trailing end of the leading article breaks free from the leading end of the succeeding article, and the leading end of the succeeding article is left protruding from the package. In this way, the leading end of the succeeding article is immediately and automatically positioned for grasping and subsequent withdrawal from the package, and what was previously the succeeding article now becomes the leading article. However, conventional packages of nonwoven sheet-type articles have typically been designed to be positioned on a flat surface such as a countertop, table, or the like in order to dispense the article in a convenient manner, by being contained within a rigid plastic container, tub, or package. The rigid plastic container provides a sealed environment for the flexible packaging to ensure that the article (s) contained therein do not become dirty or overly dry, and also to provide rigidity and structure to the flexible packaging. Particularly, existing flexible packages suffer from a lack of rigidity in the packaging, which results in compression of the packaging as the contents are dispensed, as the flexible packaging is not able to support its own weight. Further, due to the lack of rigidity, the flat surface of the flexible packaging is compromised, leaving a packaging that is deformed from its original shape. This deformation can cause a lack of flat bottom for positioning the flexible packaging on a surface, compromise the structural integrity of the pack, and render the flexible packaging with an unpleasing shape and appearance.

Of course, as discussed above, conventional packages also include flexible packaging for rolled products, such as toilet tissues and paper towels. In such packages, the products are "dispensed" by removing an entire rolled article, such as by opening one or more sides or ends of the flexible packaging, often in a non-resealable manner. Similar to sheet-type articles, as the rolled articles are dispensed, the flexible packaging is not able to withstand its own weight, resulting in a collapsed package as the rolled products are removed. Such a deformation is due to a lack of structural integrity, and results in an unpleasing shape and appearance, as well as difficulty in removing further articles.

Accordingly, an improved flexible packaging having one or more sidewalls with increased rigidity, that still allows a nonwoven article to be dispensed from the flexible packaging in the typical manner would be welcomed in the technology. Additionally, it would be beneficial to provide flexible packaging that maintains a high percentage of an initial internal volume even when some or al of an article is dispensed from the packaging. Further, it would be beneficial to provide one or more sidewalls with improved rigidity, such that the shape, including a high percentage of an initial height of the sidewalls, of the flexible packaging is retained even when some or all of an article is dispensed from the packaging.

SUMMARY OF THE INVENTION

In general, the present disclosure is directed to a flexible container for dispensing a nonwoven article. The flexible container includes at least one sidewall and a bottom wall, defining an interior cavity configured to contain one or more nonwoven articles. In addition, the flexible container has a first configuration that includes one or more nonwoven articles, and a second configuration where at least a portion of the one or more nonwoven articles are removed from the interior cavity. The flexible container is further defined in that the at least one sidewall contains at least one geometric deformation formed thereon, where the at least one geometric deformation has a height that is about 5% to about 99% of a height of the at least one sidewall, such that an interior volume of the cavity in the second configuration is about 50% or more of an interior volume of the cavity in the first configuration, a height of the at least one sidewall in a second configuration is about 50% or more of a height of the at least one sidewall in the first configuration, or a combination thereof.

In one aspect, the one or more geometric deformations include vertical lines, curved lines, triangular shapes, half-moon shapes, truss orientations, curved domes, flutes, circular shapes, letters, or combinations thereof.

In another aspect the flexible container is formed from a polymer film or a laminate, wherein the polymer film or laminate is generally impermeable to liquid, moisture, oxygen, light, or a combination thereof. Furthermore, in yet another aspect, a portion of the at least one sidewall containing the at least one geometric deformation has a thickness that is about 1.1 times a thickness of a portion of the at least one sidewall that does not have a geometric deformation formed thereon. Additionally or alternatively, the at least one sidewall includes at least a first sidewall and a second opposed sidewall, where both the first sidewall and the second opposed sidewall contain at least one geometric deformation formed thereon. In another aspect, the flexible container further includes a top portion, where the top portion is a top wall substantially parallel to the bottom wall, or wherein the top portion is a resealable closure. Additionally, or alternatively, the flexible container further includes a top wall, wherein the top wall includes a resealable closure for covering the opening. Furthermore, in an aspect, a portion of the film or laminate is sealed to a second portion of the film or laminate, to form one or more liquid impermeable seals.

Nonetheless, in one aspect, the one or more nonwoven articles comprise a wet wipe, a facial tissue, or a rolled non-woven.

The present disclosure is also generally directed to a method of forming a flexible container for dispensing a nonwoven article. The method includes forming the flexible container from a film or a laminate having at least one sidewall and a bottom wall, defining an interior cavity configured to contain one or more nonwoven articles, creating one or more geometric deformations on the at least one sidewall, and sealing the flexible container, where the at least one geometric deformation has a height that is about 5% to about 99% of a height of the at least one sidewall.

In one aspect, the one or more geometric deformations are formed by heating, pressure, ultrasonic energy, or a combination thereof. In yet another aspect, the one or more geometric deformations are formed by heating, wherein a heating temperature is greater than or equal to a glass transition temperature and less than a melt temperature of the cured film, extruded film, or laminate. Additionally or alternatively, the geometric deformations are formed using a plate, stamp, or bar.

In yet another aspect, forming the container includes forming a bottom seal on a bottom wall of the container shape, wherein the geometric deformations are formed after forming the bottom seal. In as aspect, the one or more geometric deformations include vertical lines, curved lines, triangular shapes, half-moon shapes, truss orientations, curved domes, flutes, circular shapes, letters, or combinations thereof.

In one aspect, the cured film, extruded film, or laminate is a polymer film or laminate that is generally impermeable to liquid, moisture, oxygen, light, or a combination thereof. Moreover, in an aspect, a portion of the at least one sidewall containing the at least one geometric deformation has a thickness that is about 1.1 times a thickness of a portion of the at least one sidewall that does not have a geometric deformation formed thereon. Additionally or alternatively, the method further forming one or more end seals, wherein the one or more geometric deformations are formed prior to forming at least one of the one or more end seals. In one aspect, the bottom seal, one or more end seals, or a combination thereof, are liquid impermeable seals. In another aspect, the method includes placing one or more nonwoven articles in the flexible container prior sealing, wherein the one or more non-woven articles comprise wet wipes.

BRIEF DESCRIPTION OF THE DRAWINGS

A full and enabling disclosure of the present invention, directed to one of ordinary skill in the art, is set forth in the specification, which makes reference to the appended figures, in which.

Figure 1A:
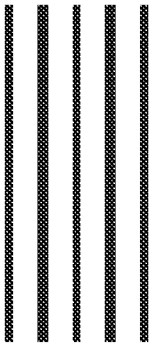
FIGS. 1A-1F illustrate geometric deformations according to an aspect of the present disclosure.
Figure 1B:
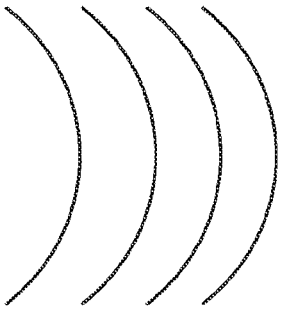
Figure 1C:
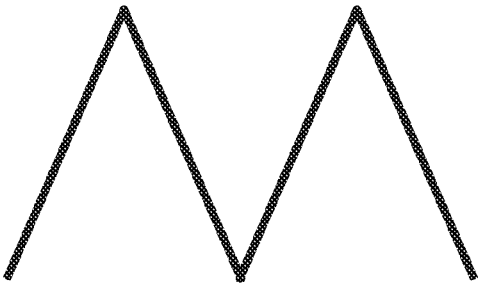
Figure 1D:
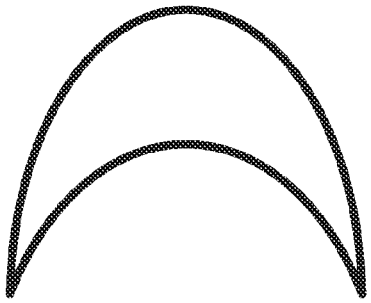
Figure 1E:
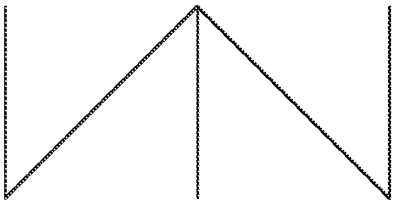
Figure 1F:
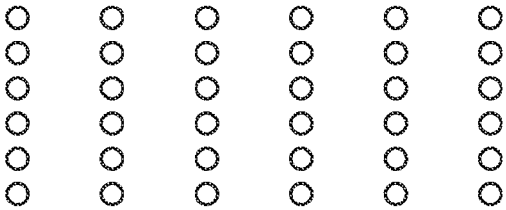

Repeat use of reference characters in the present specification and drawings is intended to represent same or analogous features or elements of the disclosure.

DETAILED DESCRIPTION OF THE INVENTION

Definitions

As used herein, the terms "about," "approximately," or "generally," when used to modify a value, indicates that the value can be raised or lowered by 10%, such as, such as 7.5%, 5%, such as 4%, such as 3%, such as 2%, such as 1%, and remain within the disclosed aspect. Moreover, the term "substantially free of" when used to describe the amount of substance in a material is not to be limited to entirely or completely free of and may correspond to a lack of any appreciable or detectable amount of the recited substance in the material. Thus, e.g., a material is "substantially free of" a substance when the amount of the substance in the material is less than the precision of an industry-accepted instrument or test for measuring the amount of the substance in the material. In certain example embodiments, a material may be "substantially free of" a substance when the amount of the substance in the material is less than 10%, less than 9%, less than 8%, less than 7%, less than 6%, less than 5%, less than 4%, less than 3%, less than 2%, less than 1%, less than 0.5%, or less than 0.1% by weight of the material As used herein, the term "fibers" generally refer to elongated extrudates that may be formed by passing a polymer through a forming orifice, such as a die. Unless noted otherwise, the term "fibers" includes discontinuous fibers having a definite length (e.g., stable fibers) and substantially continuous filaments. Substantially continuous filaments may, for instance, have a length much greater than their diameter, such as a length to diameter ratio ("aspect ratio") greater than about 15,000 to 1, and in some cases, greater than about 50,000 to 1.

As used herein the term "nonwoven web" generally refers to a web having a structure of individual fibers or threads which are interlaid, but not in an identifiable manner as in a knitted fabric. Examples of suitable nonwoven fabrics or webs include, but are not limited to, meltbbown webs, spunbond webs, bonded carded webs, airlaid webs, coform webs, hydraulically entangled webs, and so forth.

As used herein, the term "meltblown web" generally refers to a nonwoven web that is formed by a process in which a molten thermoplastic material is extruded through a plurality of fine, usually circular, die capillaries as molten fibers into converging high velocity gas (e.g., air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that are substantially continuous or discontinuous, generally smaller than 10 microns in diameter, and generally tacky when deposited onto a collecting surface.

As used herein, the term "spunbond web" generally refers to a web containing small diameter substantially continuous fibers. The fibers are formed by extruding a molten thermoplastic material from a plurality of fine, usually circular, capillaries of a spinnerette with the diameter of the extruded fibers then being rapidly reduced as by, for example, eductive drawing and/or other well-known spunbonding mechanisms. The production of spunbond webs is described and illustrated, for example, in U.S. Pat. No. 4,340,563 to Appel, et al., U.S. Pat. No. 3,692,618 to Dorschner, et al., U.S. Pat. No. 3,802,817 to Matsuki, et al., U.S. Pat. No. 3,338,992 to Kinney, U.S. Pat. No. 3,341,394 to Kinney, U.S. Pat. No. 3,502,763 to Hartman, U.S. Pat. No. 3,502,538 to Levy, U.S. Pat. No. 3,542,615 to Dobo, et al., and U.S. Pat. No. 5,382,400 to Pike, et al., which are incorporated herein in their entirety by reference thereto for all purposes. Spunbond fibers are generally not tacky when they are deposited onto a collecting surface. Spunbond fibers may sometimes have diameters less than about 40 microns, and are often between about 5 to about 20 microns.

As used herein, the terms "machine direction" or "MD" generally refers to the direction in which a material is produced (e.g., the direction the material is conveyed during the forming/manufacturing process of the nonwoven material). The term "cross-machine direction" or "CD" refers to the direction perpendicular to the machine direction.

As used herein, the term "thermal point bonding" generally refers to a process performed, for example, by passing a material between a patterned roll (e.g., calender roll) and another roll (e.g., anvil roll), which may or may not be patterned. One or both of the rolls are typically heated.

As used herein, the term "ultrasonic bonding" generally refers to a process performed, for example, by passing a material between a sonic horn and a patterned roll (e.g., anvil roll). For instance, ultrasonic bonding through the use of a stationary horn and a rotating patterned anvil roll is described in U.S. Pat. No. 3,939,033 to Grgach, et al., U.S. Pat. No. 3,844,869 to Rust Jr., and U.S. Pat. No. 4,259,399 to Hill, which are incorporated herein in their entirety by reference thereto for all purposes. Moreover, ultrasonic bonding through the use of a rotary horn with a rotating patterned anvil roll is described in U.S. Pat. No. 5,096,532 to Neuwirth, et al., U.S. Pat. No. 5,110,403 to Ehlert, and U.S. Pat. No. 5,817,199 to Brennecke, et al., which are incorporated herein in their entirety by reference thereto for all purposes. Of course, any other ultrasonic bonding technique may also be used in the present disclosure.

As used herein, "flexible" means a non-foamed polymeric containing film with a thickness of about 250 micrometers or less or a foamed polymeric containing film with a thickness of about 2000 micrometers or less.

As used herein, "rigid" means a level of stiffness commonly associated with materials used to manufacture wet wipes tubs of parts thereof. Numerically, these materials typically have a flexural modulus (as measured in accordance with ASTM D790 "Standard Test Method for Flexural Properties of Unreinforced and Reinforced Plastics and Electrical Insulating Materials") of about 100 Newtons per square millimeter or greater, more specifically from about 1100 to about 1550 Newtons per square millimeter.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally speaking, the present disclosure is directed to a flexible container for storing and dispensing nonwoven articles, where the flexible container has one or more geometric distortions applied to at least one sidewall after formation of the film or laminate used to form the respective sidewall. For instance, in one aspect, the one or more geometric distortions are applied to one or more sidewalls of the flexible container in-line with the formation of the flexible container. Particularly, the present disclosure has found that by applying one or more geometric distortions to at least one sidewall of a flexible container after formation of the film, laminate, and/or sidewall, the rigidity of the flexible film (or laminate) forming the one or more side walls can be selectively increased based upon the number and size of geometric deformations, such that the one or more side walls maintain their respective height, even when some or all of the product has been removed from the flexible packaging. Further, the rigidity of the flexible film (or laminate) forming the one or more side walls can be selectively increased based upon the number and size of geometric deformations such that the flexible container retains a high percentage of its initial volume, even as the nonwoven article(s) is dispensed.

For instance, the flexible container may be configured to contain a plurality of sheets of a nonwoven article, such as a stack of wipes, wet wipes and/or any other suitable sheet-like product(s), such as rolled non-woven articles. In one aspect, the flexible container includes a top wall, a bottom wall, a first sidewall and a second opposed sidewall extending between the top and bottom walls, a first end wall and an opposed second end wall, so as to define an enclosed volume for containing a nonwoven article. As will be discussed in greater detail below, and generally shown in FIGS. 2A-2E, the flexible container generally defines a rectangular shape, with the side walls extending substantially parallel to one another, and in one aspect, top and bottom walls also extending substantially parallel to one another. However, in other aspects, the flexible container may be configured to define any other suitable shape that allows for a plurality of sheets or rolled articles to be contained therein, and thus, in one aspect, may instead define a continuous sidewall extending between top and bottom walls, or may contain opposed sidewalls that are sealed together at a top edge. For instance, as generally shown in FIG. 2D, in such an aspect, a top portion of the sidewall or opposed sidewalls are releasably sealed, such as by a zipper or press-and-seal closure, to provide a flexible container having a bottom wall, one or more sidewalls, and a re-sealable closure that defines a top surface or wall of the packaging.

Regardless of the shape of the flexible container, at least one of the top wall, bottom wall, side walls, and/or end walls has a geometric deformation formed thereon. For example, and which will be discussed in greater detail below, the geometric deformations can be formed by stamping or pressing the at least one wall with a stamp, plate, or node(s) after the film has been extruded or cast, or, in one aspect, after the film has been laminated. Regardless of the method selected, the geometric deformations are formed according to the present disclosure in order to provide sufficient rigidity to the structure, preventing sagging of the side wall(s) and/or end wall(s), or to prevent loss of interior volume when some or al of a product is removed from the flexible container.

Referring to FIGS. 1A-1F, various exemplary geometric deformations are illustrated, such as, vertical lines (1A), curved lines (1B), triangular shapes (1C), half-moon shapes (1D), truss orientations (1E), and circular shapes, including vertical lies of adjacent circles (1F). Further, while FIGS. 1A-1F illustrate exemplary geometric deformations, other geometric deformations may also be used, particularly shapes and orientations such as triangular trusses, curved domes, flutes, letters, and combinations of the above. Further, while not shown, in one aspect, the geometric deformations are formed in a combinations of lines, curves, and domes, so as to spell out a word or a name on a side of the flexible packaging.

Figure 2A:
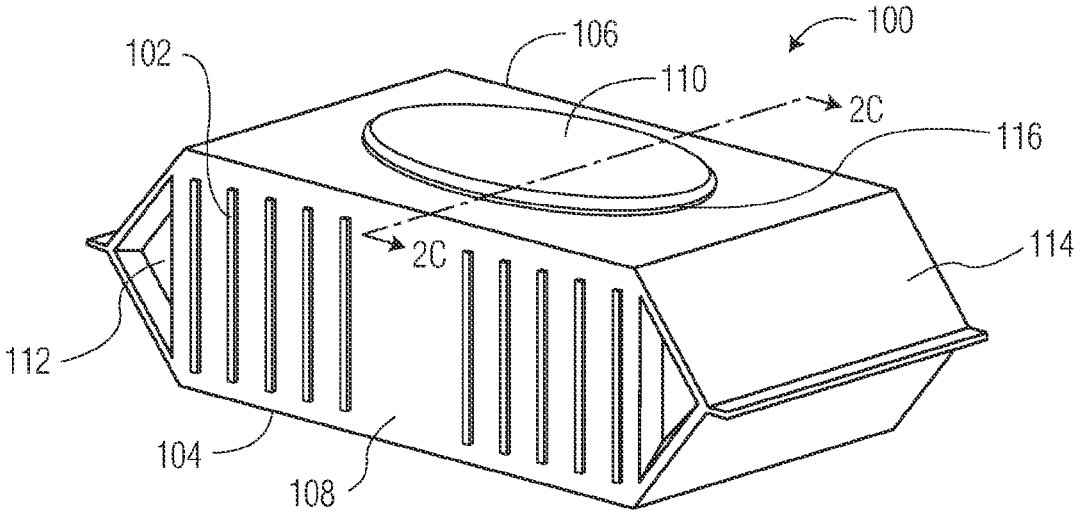
FIG. 2A illustrates a flexible container according to the present disclosure.
Figure 2B:
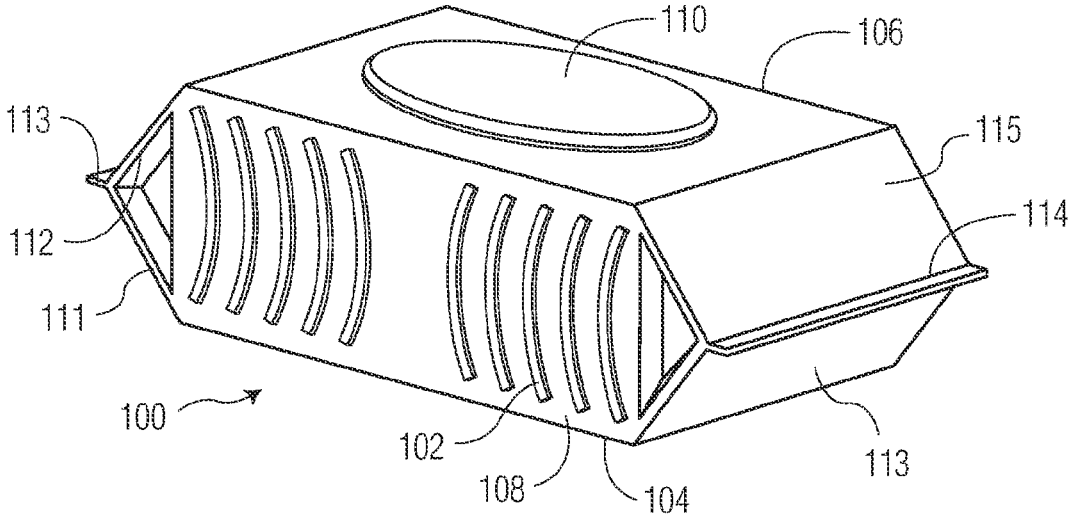
FIG. 2B illustrates a flexible container according to FIG. 2A that has been subjected to a compressive force.
Figure 2C:
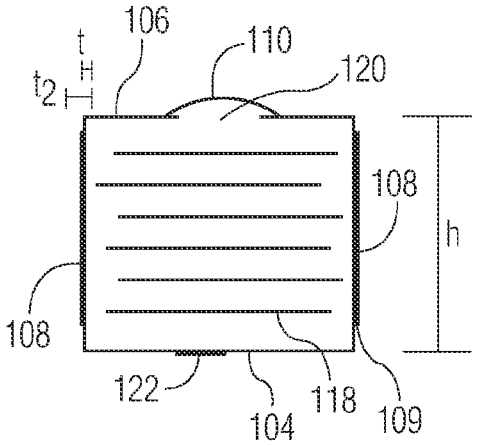
FIG. 2C illustrates a cross section of the flexible container of FIG. 2A along line c.
Figure 2D:
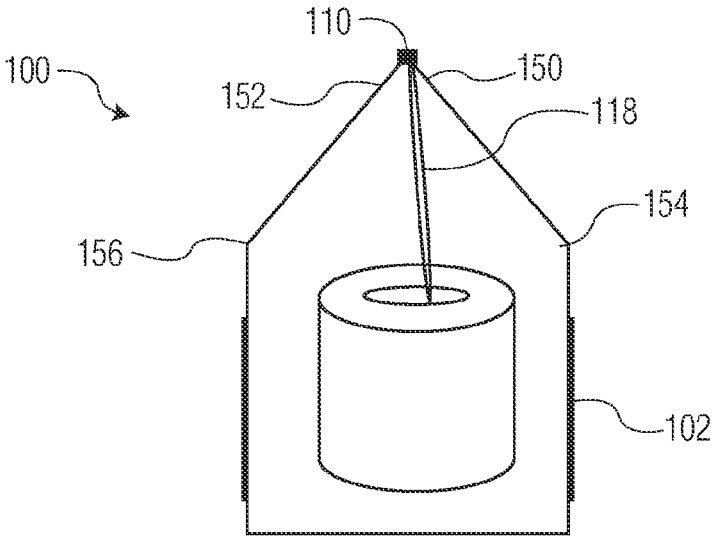
FIG. 2D illustrates an alternative flexible container according to the present disclosure.
Figure 2E:
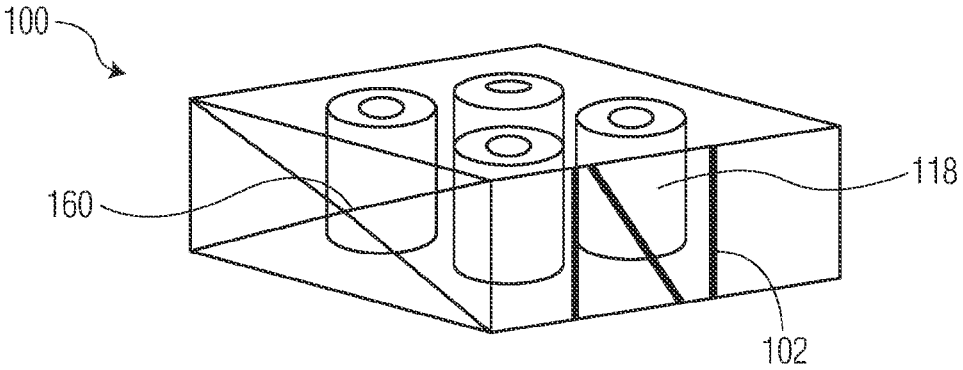
FIG. 2E illustrates an alternative flexible container according to the present disclosure.

As shown more clearly in FIGS. 2A-2C, the geometric deformations have a dimension extending in a direction generally perpendicular to the plane of the respective wall. For instance, as will be discussed in greater detail below, in one aspect, the geometric deformations may be formed by pressing the formed sidewall with a heated plate, ultrasonic bar, or induction ridges, compressing the film or laminate around the geometric deformations. Thus, in one aspect, the respective wall may have a thickness t and the geometric deformation may have a thickness $t_2$ that is about 1.1 times or greater than the thickness of the wall t (e.g. the thickness of a portion of the wall without a geometric deformation formed thereon), such as about 1.2 times or greater, such as about 1.3 times or grater, such as about 1.4 times or greater, such as about 1.5 times or greater, such as about 1.6 times or greater, such as about 1.7 times or greater, such as about 1.8 times or greater, such as about 1.9 times or greater, such as about 2 times or greater than the thickness of the wall t.

Regardless of the shape of the geometric deformation selected, in one aspect the geometric deformation has a height that is about 5% or more of the height of the respective wall (e.g. first side wall, second side wall, first end wall, second end wall, top wall, and/or bottom wall) on which the deformation(s) are formed, such as about 10% or more, such as about 15% or more, such as about 20% or more, such as about 25% or more, such as about 30% or more such as about 35% or more, such as about 40% or more, such as about 45% or more, such as about 50% or more, such as about 55% or more, such as about 60% or more, such as about 65% or more, such as about 70% or more, such as about 75% or more, such as about 85% or more, such as about 90% or more, up to about 99% or less, such as about 98% or less, such as about 97% or less, such as about 96% or less, such as about 95% or less of a height of the respective wall, or any ranges or combinations therebetween.

Further, in one aspect, the geometric deformations may occupy about 5% or more of an area of the respective wall (e.g. a percentage of the height of the respective wall multiplied by its length), such as about 10% or more, such as about 15% or more, such as about 20% or more, such as about 25% or more, such as about 30% or more such as about 35% or more, such as about 40% or more, such as about 45% or more, such as about 50% or more, such as about 55% or more, such as about 60% or more, such as about 65% or more, such as about 70% or more, such as about 75% or more, such as about 85% or more, such as about 90% or more, up to about 99% or less, such as about 98% or less, such as about 97% or less, such as about 96% or less, such as about 95% or less, such as about 90% or less, such as about 85% or less, such as about 80% or less, such as about 75% or less of an area of the respective wall, or any ranges or combinations therebetween.

Particularly, as will be discussed in greater detail below, the geometric deformations are applied after the film has been extruded or cast, or after formation into a laminate, such as, by stamping. Thus, the geometric deformations can be selected to have heights and coverage as discussed above in order to provide greater rigidity to the flexible container. For instance, as discussed above, conventional flexible containers had a height h from a bottom wall to a top wall when an interior volume of the conventional flexible container was fully occupied by a nonwoven product. However, as the nonwoven product was removed, the conventional flexible container lacked the rigidity to maintain the height h. Thus, after some or all of a product was removed, the conventional flexible container had a height $h_2$ that was less (and often far less) that the fully occupied height h.

Conversely, referring to FIGS. 2A-2E, the present disclosure has found that, when a flexible container 100 includes one or more geometric deformations 102 formed according to the above dimensions, shape, and/or coverage, the height h of the flexible container 100, defined as the distance between the lower wall 104 and the top wall 106, when an internal volume of the flexible container 100 is occupied with a nonwoven product is maintained even if some or all of a nonwoven product is removed. Thus, in one aspect $h_2$, defined as a height of the flexible container 100 after some or al of a nonwoven product has been removed, is about 50% or more of the height h, such as about 55% or more, such as about 60% or more, such as about 65% or more, such as about 70% or more, such as about 75% or more, such as about 80% or more, such as about 85% or more, such as about 90% or more, such as about 95% or more of the initial height h.

Similarly, in one aspect, the flexible container 100 may define a volume v in a fully extended or fully occupied orientation (e.g. when the internal volume is generally fully occupied in at least a height direction, by one or more nonwoven articles). For instance, in the conventional flexible container discussed above, a conventional flexible pouch may have an initial height h and an initial internal volume v when the internal volume is generally completely occupied by one or more non-woven articles. However, as the nonwoven articles are partially or fully dispensed, the conventional flexible pouch collapses into a second position, where a volume $v_2$ is less (and often substantially less) that initial volume v, as the conventional flexible container lacks sufficient rigidity to support the top wall as the nonwoven article(s) are dispensed.

Conversely, the present disclosure has found that when one or more geometric deformations are used according to the present disclosure, an internal volume, defined by the opposed side walls, top and bottom walls, and opposed end walls (for example, as other shapes may be defined as discussed above), is maintained even if some or all of a nonwoven article is removed or dispensed. Thus, in one aspect, a v2, defined as a volume of the flexible container 100 after some or all of a nonwoven product has been removed, is about 50% or more of the initial volume v, such as about 55% or more, such as about 60% or more, such as about 65% or more, such as about 70% or more, such as about 75% or more, such as about 80% or more, such as about 85% or more, such as about 90% or more, such as about 95% or more of the initial volume v.

Further, as shown in FIGS. 2A-2E, in one aspect, the geometric deformations 102 may be formed on a first wall 108 that is generally perpendicular to a bottom wall 104 and the top wall 106 of the flexible container 102. However, while not shown in FIGS. 2A-2E, a second side wall 109, opposite first side wall 108 can have geometric deformations 102 that match or mirror the geometric deformations 102 on the first wall 108. It should be understood, that, in one aspect, the geometric deformations may be different on the first side wall 108 and second side wall 109. Further, it should be understood that, in one aspect, the bottom wall 104 is configured to be placed on a surface, such as a counter, table, or the like, such that a dispenser opening 110, located on a top wall 106, is disposed in an upward facing direction. Additionally, a seal 122, also referred to as a fin seal 122 can be formed on the bottom wall 104 of the flexible container. As will be discussed in greater detail below, opposed bottom edges of the cast or extruded film, or laminate used to form the flexible container 100 are sealed to one another, forming a liquid tight seal on a bottom surface 104 of the flexible container. Similarly, the first end 112 may be formed by sealing a first end 111 of the bottom surface 104 to a first end 113 of the top surface, and a second end 114 can be formed by sealing a second end 115 of the bottom surface 104 to the second end 117 of the top surface 106. Various sealing processes may be used as known in the art to form the end seals and in seal, such as heat, pressure, or ultrasonic energy.

In addition, while not shown, in one aspect, a first end wall 112, a second end wall 114, or both the first and second end walls 112, 114 have geometric deformation(s) disposed thereon. Similarly, in an additional or alternative aspect, the bottom wall 104, the top wall 106, or both the top and bottom walls 104, 106 have geometric deformation(s) disposed thereon. Particularly, while it has been discussed that it is desirable to prevent deformation of the height of the flexible container 100, in certain aspects, it may provide a further benefit to prevent additional deformation of the flexible container 100, such as horizontal deformation. Thus, in one aspect, at least two, such as at least three, such as at least four, such as at least five, such as six of the walls have one or more geometric deformations formed thereon (or, in one aspect where a non-rectangular configuration, some or all of the walls, such as substantially all of the walls). Further, while the first end wall 112 and second end wall 114 are shown in a triangular orientation with a seam sealing the end at a midpoint of the first and second end walls, it should be understood as discussed above and as shown in FIGS. 2D and 2E, that the flexible container may have other shapes, such as a pouch, rectangle, or the like.

In one aspect, the flexible container 100 defines a dispenser opening 120 through one of its walls for providing access to the nonwoven articles(s) 118 contained therein. For instance, as shown in FIGS. 2A-2D, the dispenser opening 120 is defined through the top wall 106 of the flexible container 100. In one aspect, the dispenser opening 120 is in the form of a removable cover 110 positioned directly over the dispenser opening 120 in the top wall 106 of the flexible container 100, such as by removably sealing the cover around the outer perimeter of the opening. In such an aspect, the removable cover 110 may be pulled or peeled away tom the dispenser opening 120 to allow initial access to the sheets 106 contained within the flexible pouch 102 via the opening 120.

In addition, the dispenser opening 120 can be in the form of a resealable cap 110, and may be affixed to the flexible container 100 around the outer perimeter of the opening 120 in the top wall 106 of the flexible container 100. For example, a bottom surface 116 of the resealable cap may be coupled to a surface of the top wall 106 of the flexible container 100 around the perimeter of the opening 120 in the top wall 106. In such an aspect, the resealable cap 110 may be configured to be coupled to the top wall 106 using any suitable attachment, such as by adhering the bottom surface 116 of the cap to the top wall 106 of the flexible container 100 using a suitable adhesive or by coupling such components together using any other suitable attachment, such as heat welding.

In general, the dispenser opening 110 may be configured to be opened and closed for intermittently exposing and subsequently resealing the dispenser opening 110. As such, a re-sealable cap may be used for retaining moisture within the flexible container 100 when wet wipes and/or other moisture-retaining sheets are contained therein.

It should also be appreciated that that the resealable cap may generally be formed from any suitable material. However, in several embodiments, the resealable cap may be formed from a rigid material, such as a rigid plastic or other polymeric containing material.

However, as generally shown in FIG. 2D, in one aspect, the resealable opening 110 is formed by a resealable closure located at a top portion 150, 152, of a first and second opposed sidewalls 154, 156. In such an aspect, the resealable opening 110 may form a top portion, or top wall of the flexible container 100, that can be opened and closed to dispense nonwoven article(s) 118 therethrough. In one aspect, the nonwoven article(s) 118 may be referred to as a center-dispensing article, however, other dispensing methods and orientations as discussed above can also be used.

Nonetheless, as discussed above, and as shown generally in FIG. 2E, in one aspect, the flexible container 100 may not contain a resealable closure. Instead, an end wall 160 may be opened, and an entire nonwoven article, such as a rolled nonwoven article 118, can be removed. Regardless of the presence of one or more openings, the flexible containers described herein may have one or more geometric deformations 102 on one or more walls, allowing the flexible container to retain its shape even as some or all of an article is removed or dispensed.

It should be appreciated that the term "flexible" is generally used herein to refer to the flexible container 100 being formed from a material that is capable of being folded or flexed. For instance, in several embodiments, the flexible container 100 may be formed using a thin-walled film, such as a non-foamed polymeric containing film. In such an embodiment, the thin-walled film may, for example, have a wall thickness of less than about 2000 micrometers, such as less than about 1000 micrometers or less than about 500 micrometers.

Nonetheless, in one aspect, the flexible container 100 of the present disclosure can be formed from various materials and in various configurations. Polyolefins, polyesters, polystyrenes, or a combination thereof typically constitute tom about 60 wt. % to about 99 wt. %, in some embodiments from about 60 wt. % to about 98 wt. %, and in some embodiments, from about 80 wt. % to about 95 wt. % of the polymer composition used to form the one or more film layers and/or laminate. However, in one aspect, polyolefins or polyesters may form the polymer composition. The polyolefin may have a melting temperature of from about 100° C. to about 220° C., in some embodiments from about 120° C. to about 200° C., and in some embodiments, from about 140° C. to about 180° C. The melting temperature may be determined using differential scanning calorimetry ("DSC") in accordance with ASTM D-3417. Suitable polyolefins may, for instance, include ethylene polymers (e.g., low density polyethylene ("LDPE"), high density polyethylene ("HDPE"), linear low density polyethylene ("LLDPE"), etc.), propylene homopolymers (e.g., syndiotactic, atactic, isotactic, etc.), propylene copolymers, and so forth. In one particular embodiment, the polymer is a propylene polymer, such as homopolymer or a copolymer of propylene, an ethylene polymer such as a homopolymer or copolymer of ethylene, or a combination thereof. The propylene polymer may, for instance, be formed from a substantially isotactic polypropylene homopolymer or a copolymer containing equal to or less than about 10 wt. % of other monomers, i.e., at least about 90% by weight propylene. Such homopolymers may have a melting point of from about 140° C. to about 170° C.

Of course, other polyolefins may also be employed in the composition of the present invention. In one embodiment, for example, the polyolefin may be a copolymer of ethylene or propylene with another α-olefin, such as a $C_3$-$C_{20}$ α-olefin or $C_3$-$C_{12}$ α-olefin. Specific examples of suitable α-olefins include 1-butene; 3-methyl-1-butene; 3,3-dimethyl-1-butene; 1-pentene; 1-pentene with one or more methyl, ethyl or propyl substituents; 1-hexene with one or more methyl, ethyl or propyl substituents; 1-heptene with one or more methyl, ethyl or propyl substituents; 1-octene with one or more methyl, ethyl or propyl substituents; 1-nonene with one or more methyl, ethyl or propyl substituents; ethyl, methyl or dimethyl-substituted 1-decene; 1-dodecene; and styrene. Particularly desired α-olefin comonomers are 1-butene, 1-hexene and 1-octene. The ethylene or propylene content of such copolymers may be from about 60 mole % to about 99 mole %, in some embodiments from about 80 mole % to about 98.5 mole %, and in some embodiments, tom about 87 mole % to about 97.5 mole %. The α-olefin content may likewise range from about 1 mole % to about 40 mole %, in some embodiments from about 1.5 mole % to about 15 mole %, and in some embodiments, from about 2.5 mole % to about 13 mole %.

Exemplary olefin copolymers for use in the present invention include ethylene-based copolymers available under the designation EXACT™ from ExxonMobil Chemical Company of Houston, Texas. Other suitable ethylene copolymers are available under the designation ENGAGE™, AFFINITY™, DOWLEX™ (LLDPE) and ATTANE™ (ULDPE) from Dow Chemical Company of Midland, Michigan. Other suitable ethylene polymers are described in U.S. Pat. No. 4,937,299 to Ewen et al.; U.S. Pat. No. 5,218,071 to Tsutsui et al.; U.S. Pat. No. 5,272,236 to Lai, et al.; and U.S. Pat. No. 5,278,272 to Lai, et al. Suitable propylene copolymers are also commercially available under the designations VISTAMAXX™ from ExxonMobil Chemical Co. of Houston, Texas; FINA™ (e.g., 8573) tom Atofina Chemicals of Feluy, Belgium; TAFMER™ available tom Mitsui Petrochemical Industries; and VERSIFY™ available from Dow Chemical Co. of Midland, Michigan. Suitable polypropylene homopolymers may include Exxon Mobil 3155 polypropylene, Exxon Mobil Achieve™ resins, and Total M3661 PP resin. Other examples of suitable propylene polymers are described in U.S. Pat. No. 6,500,563 to Datta, et al.; U.S. Pat. No. 5,539,056 to Yano, et al.; and U.S. Pat. No. 5,596,052 to Resconi, et al.

Any of a variety of known techniques may generally be employed to form the olefin copolymers. For instance, olefin polymers may be formed using a free radical or a coordination catalyst (e.g., Ziegler-Natta). Preferably, the olefin polymer is formed from a single-site coordination catalyst, such as a metallocene catalyst. Such a catalyst system produces ethylene copolymers in which the comonomer is randomly distributed within a molecular chain and uniformly distributed across the different molecular weight fractions. Metallocene-catalyzed polyolefins are described, for instance, in U.S. Pat. No. 5,571,619 to McAlpin et al.; U.S. Pat. No. 5,322,728 to Davis et al.; U.S. Pat. No. 5,472,775 to Obie ski et al.; U.S. Pat. No. 5,272,236 to Lai et al.; and U.S. Pat. No. 6,090,325 to Wheat, et al. Examples of metallocene catalysts include bis(n-butylcyclopentadienyl)titanium dichloride, bis(n-butylcydopentadienyl)zirconium dichloride, bis(cyclopentadienyl)scandium chloride, bis(indenyl)zirconium dichloride, bis(methylcyclopentadienyl)titanium dichloride, bis(methylcyclopentadienyl)zirconium dichloride, cobaltocene, cyclopentadienyltitanium trichloride, ferrocene, hafnocene dichloride, isopropyl(cyclopentadienyl-1-flourenyl)zirconium dichloride, molybdocene dichloride, nickelocene, niobocene dichloride, ruthenocene, titanocene dichloride, zirconocene chloride hydride, zirconocene dichloride, and so forth. Polymers made using metallocene catalysts typically have a narrow molecular weight range. For instance, metallocene-catalyzed polymers may have polydispersity numbers ($M_w/M_n$) of below 4, controlled short chain branching distribution, and controlled isotacticity.

Nonetheless, in one aspect, the flexible container 100 can be formed from one or more polymer film layer that are generally impermeable to liquid, moisture, oxygen, light, or a combination thereof. In one aspect, a polyester film can be reverse printed, so the printing is between the two film layers. Alternatively, a single-ply surface printed film can be used. A single-ply film can be composed of one or more layers of polyolefin and in particular aspects, formed in a coextrusion.

A wide variety of ingredients may be employed in the polymer composition for a variety of different reasons. For instance, in one particular embodiment, an interphase modifier may be employed in the thermoplastic composition to help reduce the degree of friction and connectivity between any additives, including inorganic or polymeric inclusion additives and the polyolefin polymer(s). The modifier may be in a liquid or semi-solid form at room temperature (e.g., 25° C.) so that it possesses a relatively low viscosity, allowing it to be more readily incorporated into the polymer composition and to easily migrate to the polymer surfaces, and may be generally hydrophobic in nature. As used herein, the term "hydrophobic" typically refers to a material having a contact angle of water in air of about 40° or more, and in some cases, about 60° or more. In contrast, the term "hydrophilic" typically refers to a material having a contact angle of water in air of less than about 40°. One suitable test for measuring the contact angle is ASTM D5725-99 (2008). Suitable hydrophobic, low viscosity interphase modifiers may include, for instance, the liquids and/or semi-solids referenced above. One particularly suitable interphase modifier is polyether polyol, such as commercially available under the trade name PLURIOL® WI from BASF Corp. Another suitable modifier is a partially renewable ester, such as commercially available under the trade name HALLGREEN® IM from Hallstar.

When employed, the interphase modifier may constitute from about 0.05 wt. % to about 20 wt. %, in some embodiments from about 0.1 wt. % to about 15 wt. %, and in some embodiments, from about 0.5 wt. % to about 10 wt. % by weight of the polymer composition. In the amounts noted above, the interphase modifier has a character that enables it to readily migrate to the interfacial surface of the polymers and facilitate debonding without disrupting the overall melt properties of the thermoplastic composition. For example, the melt flow rate of the thermoplastic composition may also be similar to that of the polyolefin material. For example, the melt flow rate of the composition (on a dry basis) may be from about 0.1 to about 250 grams per 10 minutes, in some embodiments from about 0.5 to about 200 grams per 10 minutes, and in some embodiments, from about 5 to about 150 grams per 10 minutes, determined at a load of 2160 grams and at 190° C. in accordance with ASTM D1238.

Compatibilizers may also be employed that improve interfacial adhesion and reduce the interfacial tension between inclusion additives and the polyolefin polymer. Examples of suitable compatibilizers may include, for instance, copolymers functionalized with epoxy or maleic anhydride chemical moieties. An example of a maleic anhydride compatibilizer is polypropylene-grafted-maleic anhydride, which is commercially available from Arkema under the trade names Orevac™ 18750 and Orevac™ CA 100. When employed, compatibilizers may constitute from about 0.05 wt. % to about 10 wt. %, in some embodiments from about 0.1 wt. % to about 8 wt. %, and in some embodiments, from about 0.5 wt. % to about 5 wt. % of the thermoplastic composition, based on the weight of the continuous phase polyolefin matrix.

Other suitable materials that may also be used in the thermoplastic composition, such as catalysts, antioxidants, stabilizers, surfactants, waxes, solid solvents, nucleating agents, particulates, nanofillers, and other materials added to enhance the processability and mechanical properties of the thermoplastic composition.

To form the polymer composition, the components are typically blended together using any of a variety of known techniques. In one embodiment, for example, the components may be supplied separately or in combination. For instance, the components may first be dry mixed together to form an essentially homogeneous dry mixture, and they may likewise be supplied either simultaneously or in sequence to a melt processing device that dispersively blends the materials. Batch and/or continuous melt processing techniques may be employed. For example, a mixer/kneader, Banbury mixer, Farrel continuous mixer, single-screw extruder, twin-screw extruder, roll mill, etc., may be utilized to blend and melt process the materials. Particularly suitable melt processing devices may be a co-rotating, twin-screw extruder (e.g., ZSK-30 extruder available from Werner & Pfleiderer Corporation of Ramsey, New Jersey or a Thermo Prism™ USALAB 16 extruder available from Thermo Electron Corp., Stone, England). Such extruders may include feeding and venting ports and provide high intensity distributive and dispersive mixing. For example, the components may be fed to the same or different feeding ports of the twin-screw extruder and melt blended to form a substantially homogeneous melted mixture. If desired, other additives may also be injected into the polymer melt and/or separately fed into the extruder at a different point along its length.

For example, blending typically occurs at a temperature of from about 180° C. to about 300° C., in some embodiments from about 185° C. to about 250° C., and in some embodiments, from about 190° C. to about 240° C. Likewise, the apparent shear rate during melt processing may range from about 10 $seconds^{-1}$ to about 3000 $seconds^{-1}$, in some embodiments from about 50 $seconds^{-1}$ to about 2000 $seconds^{-1}$, and in some embodiments, from about 100 $seconds^{-1}$ to about 1200 $seconds^{-1}$. The apparent shear rate may be equal to $4Q/\pi R^3$, where Q is the volumetric flow rate ("$m^3/s$") of the polymer melt and R is the radius ("m") of the capillary (e.g., extruder die) through which the melted polymer flows. Of course, other variables, such as the residence time during melt processing, which is inversely proportional to throughput rate, may also be controlled to achieve the desired degree of homogeneity.

To achieve the desired shear conditions (e.g., rate, residence time, shear rate, melt processing temperature, etc.), the speed of the extruder screw(s) may be selected with a certain range. Generally, an increase in product temperature is observed with increasing screw speed due to the additional mechanical energy input into the system. For example, the screw speed may range from about 50 to about 600 revolutions per minute ("rpm"), in some embodiments from about 70 to about 500 rpm, and in some embodiments, from about 100 to about 300 rpm. This may result in a temperature that is sufficiently high to disperse the nanoinclusion additive without adversely impacting the size of the resulting domains. The melt shear rate, and in turn the degree to which the additives are dispersed, may also be increased through the use of one or more distributive and/or dispersive mixing elements within the mixing section of the extruder. Suitable distributive mixers for single screw extruders may include, for instance, Saxon, Dulmage, Cavity Transfer mixers, etc. Likewise, suitable dispersive mixers may include Blister ring, Leroy/Maddock, CRD mixers, etc. As is well known in the art, the mixing may be further improved by using pins in the barrel that create a folding and reorientation of the polymer melt, such as those used in Buss Kneader extruders, Cavity Transfer mixers, and Vortex Intermeshing Pin (VIP) mixers.

Any known technique may be used to form a film from the composition, including blowing, casting, flat die extruding, etc. In one particular embodiment, the film may be formed by a blown process in which a gas (e.g., air) is used to expand a bubble of the extruded polymer blend through an annular die. The bubble is then collapsed and collected in flat film form. Processes for producing blown films are described, for instance, in U.S. Pat. No. 3,354,506 to Raley; U.S. Pat. No. 3,650,649 to Schlippers; and U.S. Pat. No.

3,801,429 to Schrenk et al., as well as U.S. Patent Application Publication Nos. 2005A0245162 to McCormack, et al. and 2003/068951 to Boggs, et al. In yet another embodiment, however, the film is formed using a casting technique.

Figure 4:
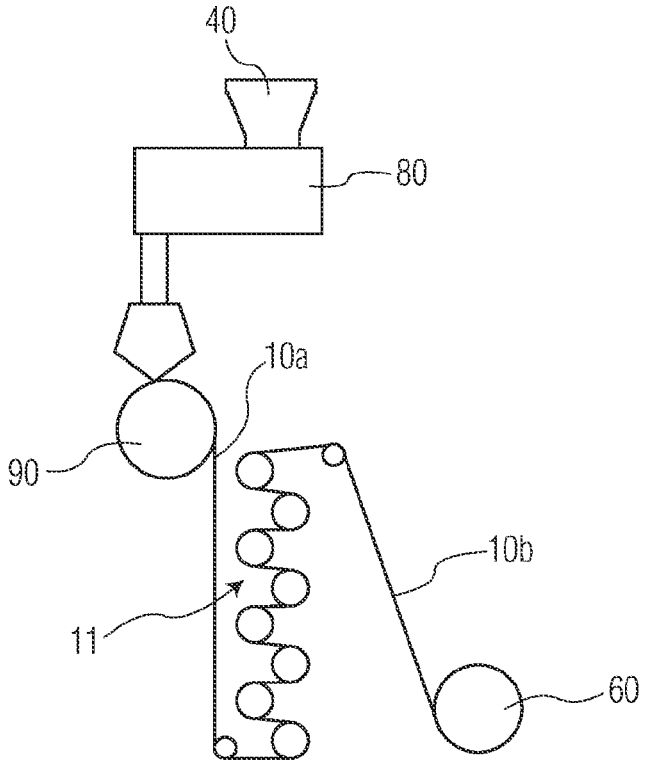
FIG. 4 illustrates a method of forming a film and/or laminate according to the present disclosure.

Referring to FIG. 4, for instance, one embodiment of a method for forming a cast film is shown. In this embodiment, the raw materials (not shown) are supplied to the extruder 80 from a hopper 40 and then cast onto a casting roll 90 to form a single-layered precursor film 10*a*. If a multilayered film is to be produced, the multiple layers are co-extruded together onto the casting roll 90. The casting roll 90 may optionally be provided with embossing elements to impart a pattern to the film. Typically, the casting roll 90 is kept at temperature sufficient to solidify and quench the sheet 10*a* as it is formed, such as from about 10 to 60° C. If desired, a vacuum box may be positioned adjacent to the casting roll 90 to help keep the precursor film 10*a* close to the surface of the roll 90. Additionally, air knives or electrostatic pinners may help force the precursor film 10*a* against the surface of the casting roll 90 as it moves around a spinning roll. An air knife is a device known in the art that focuses a stream of air at a very high flow rate to pin the edges of the film.

Once cast, the film 10*a* may then be optionally oriented in one or more directions to further improve film uniformity. The film may be immediately reheated to a temperature below the melting point of one or more polymers in the film, but high enough to enable the composition to be drawn or stretched. In the case of sequential orientation, the "softened" film is drawn by rolls rotating at different speeds of rotation such that the sheet is stretched to the desired draw ratio in the longitudinal direction (machine direction). This "uniaxially" oriented film may then be optionally laminated to a fibrous web. In addition, the uniaxially oriented film may also be oriented in the cross-machine direction to form a "biaxially oriented" film. For example, the film may be clamped at its lateral edges by chain clips and conveyed into a tenter oven. In the tenter oven, the film may be reheated and drawn in the cross-machine direction to the desired draw ratio by chain clips diverged in their forward travel.

Referring again to FIG. 4, for instance, one method for forming a uniaxially oriented film is shown. As illustrated, the precursor film 10*a* is directed to a film-orientation unit 11 or machine direction orienter ("MDO"), such as commercially available from Marshall and Williams, Co. of Providence, Rhode Island. The MDO has a plurality of stretching rolls (such as from 5 to 8) which progressively stretch and thin the film in the machine direction, which is the direction of travel of the film through the process as shown in FIG. 4. Mile the MDO 100 is illustrated with eight rolls, it should be understood that the number of rolls may be higher or lower, depending on the level of stretch that is desired and the degrees of stretching between each roll. The film may be stretched in either single or multiple discrete stretching operations. It should be noted that some of the rolls in an MDO apparatus may not be operating at progressively higher speeds. If desired, some of the rolls of the MDO 100 may act as preheat rolls. If present, these first few rolls heat the film 10*a* above room temperature (e.g., to 125° F.). The progressively faster speeds of adjacent rolls in the MDO act to stretch the film 10*a*. The rate at which the stretch rolls rotate determines the amount of stretch in the film and final film weight.

The resulting film 10*b* may then be wound and stored on a take-up roll 60. While not shown here, various additional potential processing and/or finishing steps known in the art, such as slitting, treating, aperturing, printing graphics, or lamination of the film with other layers (e.g., nonwoven web materials), may be performed without departing from the spirit and scope of the disclosure.

The film of the present invention may be mono- or multi-layered (e.g., from 1 to 20 layers, and in some embodiments, from 1 to 10 layers). For example, a multi-layered film may contain at least one core layer that is positioned adjacent to at least one outer layer. Outer layers are often used for heat sealing or printing. In one embodiment, for example, it may be desirable to employ first and second outer layers that sandwich the core layer. When multiple layers are used, core layer(s) typically constitute a substantial portion of the weight of the film, such as from about 50 wt. % to about 99 wt. %, in some embodiments from about 55 wt. % to about 90 wt. %, and in some embodiments, from about 60 wt. % to about 85 wt. % of the film. The outer layer(s) may likewise constitute from about 1 wt. % to about 50 wt. %, in some embodiments from about 10 wt. % to about 45 wt. %, and in some embodiments, from about 15 wt. % to about 40 wt. % of the film.

Regardless of the form of the film ad/or laminate used in the formation of the flexible container 100 selected, in one aspect, the flexible container 100 contains a nonwoven web formed from a fibrous substrate, that may contain one or more wiping solutions (if in the form of a wet wipe). The fibrous substrate may be formed from any of a variety of materials that are well known in the art. In some embodiments, for example, the fibrous substrate may be a paper product containing one or more paper webs, such as a wipe, paper towel, napkin, facial tissue, bath tissue, and so forth. The particular nature of the fibrous substrate may vary depending on the intended use, and may include materials such as the nonwoven webs defined above, knitted fabrics, woven fabrics, cotton fabrics, etc.

In one aspect, for example, the fibrous substrate can include a nonwoven web that contains an absorbent material of sufficient wet strength and absorbency for use in the desired application. For example, the nonwoven web may include absorbent cellulosic fibers formed by a variety of pulping processes, such as kraft pulp, sulfite pulp, thermomechanical pulp, etc. Such pulp fibers may be high-average fiber length pulp, low-average fiber length pulp, or mixtures thereof. One example of suitable high-average length luff pulp fibers includes softwood kraft pulp fibers. Softwood kraft pulp fibers are derived from coniferous trees and include pulp fibers such as, but not limited to, northern, western, and southern softwood species, including redwood, red cedar, hemlock, Douglas fir, true firs, pine (e.g., southern pines), spruce (e.g., black spruce), combinations thereof, and so forth. Northern softwood kraft pulp fibers may be used in the present invention. An example of commercially available southern softwood kraft pulp fibers suitable for use in the present invention include those available from Weyerhaeuser Company with offices in Federal Way, Washington under the trade designation of "NF-405." Another suitable pulp for use in the present invention is a bleached, sulfate wood pulp containing primarily softwood fibers that is available from Bowater Corp. with offices in Greenville, SC under the trade name CoosAbsorb S pulp. Low-average length fibers may also be used in the present invention. An example of suitable low-average length pulp fibers is hardwood kraft pulp fibers. Hardwood kraft pulp fibers are derived from deciduous trees and include pulp fibers such as, but not limited to, eucalyptus, maple, birch, aspen, etc. Eucalyptus kraft pulp fibers may be particularly desired to increase softness, enhance brightness, increase opacity, and change the pore structure of the sheet to increase its wicking ability. Further, other absorbent fibers that may be used in the present invention, such as abaca, sabai grass, milkweed floss, pineapple leaf, cellulosic esters, cellulosic ethers, cellulosic nitrates, cellulosic acetates, cellulosic acetate butyrates, ethyl cellulose, regenerated celluloses (e.g., viscose or rayon), and so forth.

Synthetic thermoplastic fibers may also be employed in the nonwoven web, such as those formed from polyolefins, e.g., polyethylene, polypropylene, polybutylene, etc.; polytetrafluoroethylene; polyesters, e.g., polyethylene terephthalate and so forth; polyvinyl acetate; polyvinyl chloride acetate; polyvinyl butyral; acrylic resins, e.g., polyacrylate, polymethylacrylate, polymethylmethacrylate, and so forth; polyamides, e.g., nylon; polyvinyl chloride; polyvinylidene chloride; polystyrene; polyvinyl alcohol; polyurethanes; polylactic acid; copolymers thereof; and so forth. Because many synthetic thermoplastic fibers are inherently hydrophobic (i.e., non-wettable), such fibers may optionally be rendered more hydrophilic (i.e., wettable) by treatment with a surfactant solution before, during, and/or after web formation. Other known methods for increasing wettability may also be employed, such as described in U.S. Pat. No. 5,057,361 to Savovitz, et al.

When employed, the synthetic fibers may be monocomponent or multicomponent. Multicomponent fibers are fibers that have been formed from at least two polymer components. Such fibers are usually extruded from separate extruders but spun together to form one fiber. The polymers of the respective components are usually different from each other although multicomponent fibers may include separate components of similar or identical polymeric materials. The individual components are typically arranged in substantially constantly positioned distinct zones across the cross-section of the fiber and extend substantially along the entire length of the fiber. The configuration of such fibers may be, for example, a side-by-side arrangement, a pie arrangement, or any other arrangement. Multicomponent fibers and methods of making the same are taught in U.S. Pat. No. 5,108,820 to Kaneko, et al., U.S. Pat. No. 4,795,668 to Kruege, et al., U.S. Pat. No. 5,162,074 to Hills, U.S. Pat. No. 5,277,976 to Hole, et al. U.S. Pat. No. 5,336,552 to Strack, et al., U.S. Pat. No. 5,466,410 to Hills, U.S. Pat. No. 5,069,970 to Largman, et al., U.S. Pat. No. 5,057,368 to Largman, et al., U.S. Pat. No. 5,382,400 to Pike, et al., and U.S. Pat. No. 5,989,004 to Cook. When utilized, multicomponent fibers can also be splittable. In fabricating multicomponent fibers that are splittable, the individual segments that collectively form the unitary multicomponent fiber are contiguous along the longitudinal direction of the multicomponent fiber in a manner such that one or more segments form part of the outer surface of the unitary multicomponent fiber. In other words, one or more segments are exposed along the outer perimeter of the multicomponent fiber. For example, splittable multicomponent fibers and methods for making such fibers are described in U.S. Pat. No. 5,935,883 to Pike and U.S. Pat. No. 6,200,669 to Marmon, et al.

If desired, the nonwoven web material may be a composite that contains a combination of synthetic thermoplastic polymer fibers and absorbent fibers, such as polypropylene and pulp fibers. The relative percentages of such fibers may vary over a wide range depending on the desired characteristics of the nonwoven composite. For example, the nonwoven composite may contain from about 1 wt. % to about 60 wt. %, in some embodiments from 5 wt. % to about 50 wt. %, and in some embodiments, from about 10 wt. % to about 40 wt. % synthetic polymeric fibers. The non-woven composite may likewise contain from about 40 wt. % to about 99 wt. %, in some embodiments from 50 wt. % to about 95 wt. %, and in some embodiments, from about 60 wt. % to about 90 wt. % absorbent fibers.

Nonwoven composites may be formed using a variety of known techniques. For example, the nonwoven composite may be a "coform material" that contains a mixture or stabilized matrix of thermoplastic fibers and a second non-thermoplastic material. As an example, coform materials may be made by a process in which at least one meltblown die head is arranged near a chute through which other materials are added to the web while it is forming. Such other materials may include, but are not limited to, fibrous organic materials such as woody or non-woody pulp such as cotton, rayon, recycled paper, pulp fluff and also superabsorbent particles, inorganic and/or organic absorbent materials, treated polymeric staple fibers and so forth. Some examples of such coform materials are disclosed in U.S. Pat. No. 4,100,324 to Anderson, et al.; U.S. Pat. No. 5,284,703 to Everhart, at al.; and U.S. Pat. No. 5,350,624 to Georger, et al.; which are incorporated herein in their entirety by reference thereto for all relevant purposes.

Alternatively, the nonwoven composite may be formed be formed by hydraulically entangling fibers and/or filaments with high-pressure jet streams of water. Hydraulically entangled non-woven composites of staple length fibers and continuous filaments are disclosed, for example, in U.S. Pat. No. 3,494,821 to Evans and U.S. Pat. No. 4,144,370 to Boulton, which are incorporated herein in their entirety by reference thereto for all purposes. Hydraulically entangled nonwoven composites of a continuous filament nonwoven web and pulp fibers are disclosed, for example, in U.S. Pat. No. 5,284,703 to Everhart, et al., and U.S. Pat. No. 6,315,864 to Anderson, at al., which are incorporated herein in their entirety by reference thereto for all purposes.

Typically, the basis weight of fibrous substrate can range from about 20 grams per square meter (gsm) to about 500 gsm, such as from about 35 gsm to about 350 gem, such as from about 50 gsm to about 200 gsm. Lower basis weight products may be particularly well suited for use as light duty wipes, while higher basis weight products may be better adapted for use as industrial wipes.

Regardless of the particular manner by which the fibrous substrate is made, in one aspect, the fibrous substrate can be in the form of a wipe or a facial tissue, and may assume a variety of shapes, including but not limited to, generally circular, oval, square, rectangular, or irregularly shaped. Each individual wipe may be arranged in a folded configuration and stacked one on top of the other to provide a stack of wipes, or may be rolled into a rolled configuration, which can be further impregnated with one or more wiping solutions if in the form of wet wipes. Such folded and rolled configurations are well known to those skilled in the art and include c-folded, z-folded, quarter-folded configurations and so forth. For example, the wipe may have an unfolded length of from about 2.0 to about 80.0 centimeters, and in some embodiments, from about 10.0 to about 25.0 centimeters. The wipes may likewise have an unfolded width of from about 2.0 to about 80.0 centimeters, and in some embodiments, torn about 10.0 to about 25.0 centimeters. Alternatively, the wipes may include a continuous strip of material which has perforations between each wipe and which may be arranged in a stack or wound into a roll for dispensing. Various suitable dispensers, containers, and systems for delivering wipes are described in U.S. Pat. No. 5,785,179 to Buzwinski, et al.; U.S. Pat. No. 5,964,351 to Zander, U.S. Pat. No. 6,030,331 to Zander, U.S. Pat. No. 6,158,614 to Haynes, et al.; U.S. Pat. No. 6,269,969 to Huang, et al.; U.S.

Pat. No. 6,269,970 to Huang, et al.; and U.S. Pat. No. 6,273,359 to Newman, et al., which are incorporated herein in their entirety by reference thereto for all purposes.

Furthermore, as discussed above, in one aspect, the non-woven articles can be in the form of a wipe that contain a liquid which can be any solution which can be absorbed into the wipes, thus making them "wet wipes." The liquid contained within the wet wipes can include any suitable components which provide the desired wiping properties. For example, the components can include water, emollients, surfactants, preservatives, chelating agents, pH buffers, fragrances, or combinations thereof. The liquid can also contain lotions, ointments, and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 200 to about 400 weight percent liquid based on the dry weight of the wipe for improved wiping.

Figure 3:
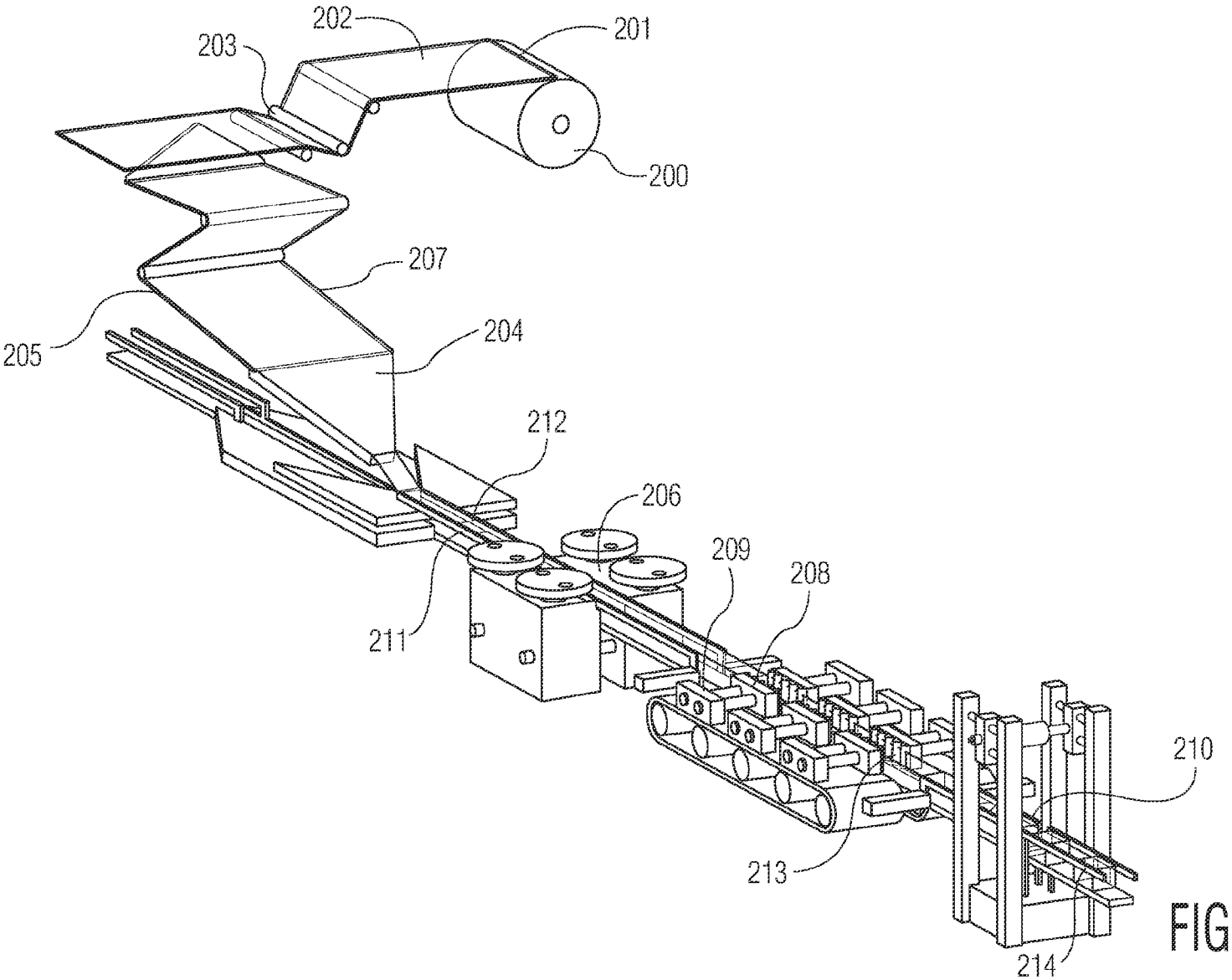
FIG. 3 illustrates method of forming a flexible container according to the present disclosure.

The present disclose is also generally directed to a method of forming a flexible container having improved rigidity. For instance, referring to FIG. 3, in one aspect, a roll 200 containing a film or laminate 202 is unwound 201. As discussed above, in one aspect, the film 202 can be any extruded or cast film, or laminate. Nonetheless, as should be understood, the film has already been formed, and is therefore deformed after the film has been extruded, cast, laminated, or otherwise processed as discussed above.

While not shown, in one aspect, the film or laminate 202 may undergo geometric deformation after the unrolling 201 of the film or laminate 202 but prior to the fin sealing 206 (where opposed edges of the film or laminate are sealed together on a bottom wall of the flexible container). For instance, one or more rollers 203 can be a heated, induction, or ultrasonic die roller. Further, while not shown, the geometric deformation process can also occur after unrolling 201, and after formation 204 (where the first edge 205 and second edge 207 of the film or laminate 202 are brought together to form a tube-shaped rectangular form with open leading and trailing ends), but prior to fin sealing 206. For instance, stamps/plates 209, which may be heated or ultrasonic, or bars (not shown), such as a stamp/plate having one or more heated notes, may be pressed into a first side wall 211, second side wall (shown more dearly in FIG. 2C), bottom wall (shown more clearly in FIG. 2C), top wall 212, or a combination thereof, prior to fin sealing 206. Further, while stamp 209 is shown as having a plurality of vertical ridges 213, it should be understood that the stamp 209 or a rolling bar may be used that impart different geometries, such as any of the geometries shown in FIG. 1 or noted above. Further, while a plurality of ridges 213 are shown on stamp 209, it should also be understood that the stamp 209 may have geometries, such as ridges 213 spaced such that each flexible container contains only one geometric deformation, or more geometric deformations, such as two or more, such as three or more, such as four or more, such as five or more, such as 6 or more, such as 7 or more, such as 8 or more, as discussed and shown above.

Nonetheless, the film or laminate 202 proceeds from the unrolling process 201 to the container formation process 204, where a first edge 205 and a second edge 207 of the film or laminate 202 can be sealed together during fin sealing 206. Particularly, as discussed above, the first edge 205 and opposed second edge 207 may generally be sealed together on a bottom wall of the flexible container. The fin sealing 206 can be completed via pressure, heat, ultrasonic, or other methods as known in the art.

After fin sealing 206 the film or laminate 202 proceeds towards the cutting section 208. In one aspect, the geometric deformations are applied to a first side wall 211, second side wall (shown more clearly in FIG. 2C), bottom wall (shown more dearly in FIG. 2C), top wall 212, or a combination thereof after cutting the film or laminate 202 into single flexible container 214 sections but prior to end sealing 210. For instance, the one or more geometric deformations may be applied after cutting 208 but prior to end sealing 210, using any of the above discussed methods. However, in one aspect, a stamp 209 using heat, pressure, ultrasonic energy, induction, or a combination thereof, is used to form the one or more geometric deformations.

Nonetheless, after cutting 208, the flexible container 214 sections proceed to end sealing 210, where first and second ends, as discussed above, are formed by using pressure, heat, ultrasonic energy, or a combination thereof, to form an end seal on the first and second ends (shown more clearly in FIG. 2, to form flexible container 214 having one or more geometric deformations, on one or more of a first side wall 211, second side wall (shown more clearly in FIG. 2C), bottom wall (shown more dearly in FIG. 2C), top wall 212, a first end (shown more dearly in FIG. 2), a second end (shown more dearly in FIG. 2) or a combination thereof, enclosing one or more articles in the flexible container. Of course, it should be understood that the process described can be used to form a container having any shape, such as any shape according to FIGS. 2A-2E.

While the above has discussed a method of forming a flexible container according to the present disclosure, in one aspect, the geometric deformations are formed after cutting 208 but prior to end sealing 210. Particularly, such an aspect may allow excess air to be pushed from the flexible container prior to end sealing. Of course, in a further aspect, the geometric deformations may be formed at any of the process steps discussed above.

Further, in one aspect, the geometric deformations are formed by using heating, such as a stamp or plate with heated notes or elements, where the heating is at a temperature less than the melt temperature of the film or laminate (Tm), but greater or equal to a glass transition temperature of the film or laminate (Tg). Particularly, by using such a temperature, the geometric distortions can be incorporated into the polymer film structure after extrusion or casting, providing improved rigidity to the flexible film in a direction so as to improve one or more of the above problems.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A flexible container for dispensing a nonwoven article, comprising:

at least one sidewall and a bottom wall, defining an interior cavity configured to contain one or more non-woven articles;

the flexible container having a first configuration containing one or more non-woven articles, and a second configuration wherein at least a portion of the one or more non-woven articles are removed from the interior cavity;

wherein the at least one sidewall contains at least one geometric deformation formed thereon, wherein the at least one geometric deformation has a height that is 5% to 99% of a height of the at least one sidewall, such that an interior volume of the cavity in the second configuration is 50% or more of an interior volume of the cavity in the first configuration, a height of the at least one sidewall in a second configuration is about 50% or more of a height of the at least one sidewall in the first configuration, or a combination thereof.

2. The flexible container of claim 1, wherein the at least one geometric deformation comprises vertical lines, curved lines, triangular shapes, half-moon shapes, truss orientations, curved domes, flutes, circular shapes, letters, or combinations thereof.

3. The flexible container of claim 1, wherein the flexible container is formed from a polymer film or a laminate, wherein the polymer film or laminate is generally impermeable to liquid, moisture, oxygen, light, or a combination thereof.

4. The flexible container of any one of claim 1, wherein a portion of the at least one sidewall containing the at least one geometric deformation has a thickness that is 1.1 times a thickness of a portion of the at least one sidewall that does not have the at least one geometric deformation formed thereon.

5. The flexible container of claim 1, wherein the at least one sidewall comprises at least a first sidewall and a second opposed sidewall, where both the first sidewall and the second opposed sidewall contain at least one geometric deformation formed thereon.

6. The flexible container of claim 1, wherein further comprising a top portion, wherein the top portion is a top wall parallel to the bottom wall, or wherein the top portion is a resealable closure.

7. The flexible container of claim 1, further comprising a top wall, wherein the top wall includes a resealable closure for covering an opening defined on the flexible container.

8. The flexible container of claim 1, wherein the one or more nonwoven articles comprise a wet wipe, a facial tissue, or a rolled non-woven.

9. The flexible container of claim 1, wherein a portion of the polymer film or laminate is sealed to a second portion of the film or laminate, to form one or more liquid impermeable seals.

10. A method of forming a flexible container for dispensing a nonwoven article, the method comprising, forming the flexible container from a film or a laminate having at least one sidewall extending between a top wall and a bottom wall, defining an interior cavity configured to contain one or more nonwoven articles;

creating at least one geometric deformation on the at least one sidewall; and sealing the flexible container;

wherein the at least one geometric deformation has a height that is 5% to 99% of a height of the at least one sidewall.

11. The method of claim 10, wherein the at least one geometric deformation is formed by heating, pressure, ultrasonic energy, or a combination thereof.

12. The method of claim 10, wherein the one or more geometric deformations are formed by heating, wherein a heating temperature is greater than or equal to a glass transition temperature and less than a melt temperature of the film or laminate.

13. The method of claim 10, wherein the at least one geometric deformation is formed using a plate, stamp, or bar.

14. The method of claim 10, wherein forming the container includes forming a bottom seal on a bottom wall of the container shape, wherein the at least one geometric deformations are formed after forming the bottom seal.

15. The method of one of claim 10, wherein the at least one geometric deformation comprises vertical lines, curved lines, triangular shapes, half-moon shapes, truss orientations, curved domes, flutes, circular shapes, letters, or combinations thereof.

16. The method of one of claim 10, wherein the film or laminate is a polymer film or laminate that is generally impermeable to liquid, moisture, oxygen, light, or a combination thereof.

17. The method of one of claim 10, wherein a portion of the at least one sidewall containing the at least one geometric deformation has a thickness that is about 1.1 times a thickness of a portion of the at least one sidewall that does not have the at least one geometric deformation formed thereon.

18. The method of claim 10, the method further forming one or more end seals, wherein the at least one geometric deformation is formed prior to forming at least one of the one or more end seals.

19. The method of claim 10, wherein the bottom seal, one or more end seals, or a combination thereof, are liquid impermeable seals.

20. The method of claim 10, further comprising placing one or more nonwoven articles in the flexible container prior to sealing the flexible container, wherein the one or more nonwoven articles comprise wet wipe.

* * * * *